United States Patent [19]

Benner et al.

[11] 4,323,814

[45] Apr. 6, 1982

[54] MESH ASSEMBLY HAVING REDUCED MICROPHONICS FOR A PICK-UP TUBE

[75] Inventors: Timothy E. Benner; Alfred Month, both of Lancaster, Pa.

[73] Assignee: RCA Corporation, New York, N.Y.

[21] Appl. No.: 150,341

[22] Filed: May 16, 1980

[51] Int. Cl.[3] ..... H01J 29/02; H01J 29/08

[52] U.S. Cl. ..... 313/390; 313/383

[58] Field of Search ..... 313/376, 378, 383, 384, 313/390, 269

[56] References Cited

U.S. PATENT DOCUMENTS

| | | | |
|---|---|---|---|
| 2,493,539 | 1/1950 | Law . | |
| 2,582,843 | 1/1952 | Moore | 313/376 |
| 2,802,126 | 8/1957 | Day . | |
| 2,909,687 | 10/1959 | Turk et al. . | |
| 3,137,803 | 6/1964 | Ney et al. . | |
| 3,202,857 | 8/1965 | Antoniades . | |
| 3,287,585 | 11/1966 | Randels . | |
| 3,295,006 | 12/1966 | Ziedonis | 313/269 |
| 3,303,373 | 2/1967 | Alting-Mees . | |
| 3,437,860 | 4/1969 | Ney . | |
| 3,461,336 | 8/1969 | Fuller et al. | 313/269 |
| 3,860,851 | 1/1975 | Hamersma | 313/456 |
| 3,906,278 | 9/1975 | Horton | 313/383 |
| 4,004,177 | 1/1977 | Hattum et al. | 313/390 |
| 4,079,286 | 3/1978 | Popp | 313/383 |
| 4,169,986 | 10/1979 | Stelwagen et al. | 313/383 |

OTHER PUBLICATIONS

Tube Talk; EEV, Inc., Mar. 1979.

*Primary Examiner*—Eli Lieberman

*Attorney, Agent, or Firm*—Eugene M. Whitacre; Dennis H. Irlbeck; Vincent J. Coughlin, Jr.

[57] ABSTRACT

A pick-up tube includes a generally cylindrical envelope having a faceplate at one end thereof and a cathode in the other end. A photoconductive target electrode is adjacent to the faceplate and a mesh assembly is disposed in spaced relation adjacent to the target electrode, between the target electrode and the cathode. The mesh assembly comprises a mesh electrode disposed between a frustro-conically shaped mesh support ring and a dished, spring-like mesh damping ring. The mesh damping ring is fixedly attached at a plurality of points around its periphery to the mesh electrode and the mesh support ring. The mesh damping ring is compressed into a reversal of its dished shape and assumes an undulatory configuration contacting the mesh electrode periodically around the inner periphery of the damping ring thereby retaining the mesh electrode with reduced microphonics.

7 Claims, 3 Drawing Figures

MESH ASSEMBLY HAVING REDUCED MICROPHONICS FOR A PICK-UP TUBE

BACKGROUND OF THE INVENTION

This invention relates to television pick-up tubes and particularly to a mesh assembly having reduced microphonics for such a tube.

Microphonics is a physical vibration of some portion of a tube which, because of its movement produces an undesirable electrical signal output or noise which manifests itself as a background of lines or striations in a television picture.

In a vidicon type pick-up tube a mesh grid is disposed between a photoconductive target and an electron gun which provides a scanning electron beam. The mesh provides a lens action which causes the electron beam from the electron gun to impinge perpendicularly on the target electrode. The mesh is usually supported around its periphery by at least one annular support ring.

When such tubes are subjected to mechanical shock, for example in vehicles or equipment, and vibrations from, for example, cooling fans or incident sound from external sources, the conductive mesh will start vibrating relative to the photoconductive target and cause microphonic effects which produced the above-described background lines and striations in the picture.

Many expedients have been adopted to eliminate the undesirable microphonic effects. Among the expedients adopted is a structure described in U.S. Pat. No. 3,906,278 to Horton et al., issued Sept. 16, 1975 comprising a fine conductive mesh and an annular corrugated washer of flexible mesh material clamped between two annular members. The annular members are dished away from each other beyond the region of clamping. The flexible mesh washer extends inwardly beyond the region of clamping and contacts both the fine conductive mesh and the dished portion of one of the clamping members in order to damp vibrations. The Horton et al. structure is complex and requires a precisely formed flexible mesh washer. If the corrugations of the mesh washer are too shallow the washer will not contact both the dished annular member and the fine mesh. If this occurs, little or no damping will occur. Being constructed from mesh, the flexible washer also tends to undergo a change in elasticity after repeated thermal and mechanical cycling thus decreasing the effectiveness of the damping action. It is therefore desirable to find a low cost, reliable mesh mounting system which provides sufficient mesh taughtness and damping to reduce microphonics.

SUMMARY OF THE INVENTION

A pick-up tube includes a photoconductive target electrode, a mesh assembly disposed in spaced relationship therefrom, and a cathode. The mesh assembly comprises a mesh electrode disposed between a frustro-conically shaped mesh support ring and a spring-like dished mesh damping ring. The mesh damping ring is fixedly attached at a plurality of points around its outer periphery to the mesh electrode and the mesh support ring. The fixedly attached mesh damping ring, which is compressed into a reversal of its dished shape, assumes an undulatory configuration contacting the mesh electrode periodically around the inner periphery of the damping ring thereby retaining the mesh electrode with reduced microphonics.

DETAILED DESCRIPTION OF THE PREFERRED EMBODIMENT

Figure 1:
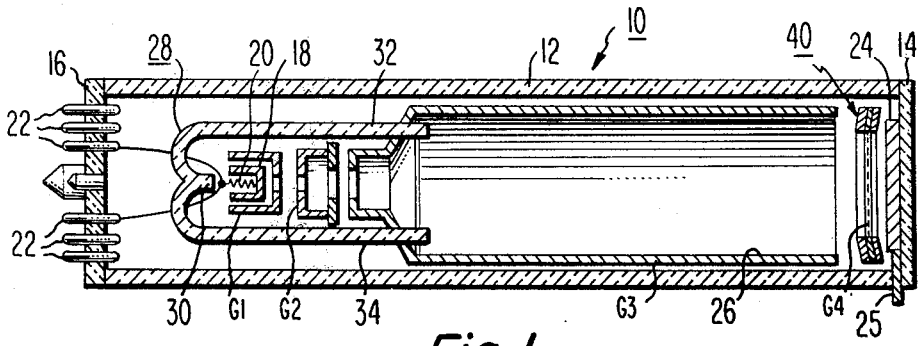
FIG. 1 is a cross sectional view of a pick-up tube showing the novel mesh assembly structure.

Referring to the drawing, there is shown in FIG. 1 a vidicon type pick-up tube 10 having a generally cylindrical glass envelope 12 closed at one end by a transparent glass faceplate 14 and at the other end by a transparent glass base plate 16. The interior of the enclosed envelope 12 is suitably evacuated.

The tube 10 comprises a cathode 18 which is heated by a filament 20, the filament being suitably connected to two of a plurality of lead pins 22 which are vacuum sealed through the base plate 16. G1, G2, G3 and G4 are the normally provided electrodes known under those designations. A target 24 comprises a photoconductive layer of, for example, lead monoxide, selenium-arsenic-tellurium or another suitable material well known in the art. The photoconductive layer is deposited on a film of conductive tin oxide (not shown) on the inside portion of the faceplate 14. An electrical contact may be made to the target 24 by a connector 25. The connector 25, typically a tab or strip of metal, such as platinum, is connected to the target 24 and extends through the glass envelope 12 in a vacuum seal to make an external electrical connection.

The light scattering interior surface 26 of the G3 anode electrode may be roughened by chemical etching or sandblasting in a manner well known in the art. Light is directed into the interior of the anode electrode G3 by means of a bifurcated, rod-shaped light conductor 28. The light conductor 28 is bent in such a way that a part of the light irradiated by the filament 20 is guided through a stem 30 of the conductor 28 and thence through two branches, 32 and 34. The branches 32 and 34 are arranged to extend toward the target 24 and into the interior of the anode electrode G3 into which the light from the conductor 28 emanates.

As so far described, the lead monoxide target pick-up tube is known, per se. In such a prior art structure the G4 electrode is a fine conductive mesh or gauze made of electroformed copper or nickel. The G4 electrode includes about 1000 wires per inch in mutually orthogonal relation. This results in grid openings of about $0.0005 \times 0.0005$ inch ($12 \times 12$ microns). The thickness of the grid is about 0.0002 inch (5 microns). The G4 electrode includes a support structure which may be formed of at least one but preferably two support rings. The support rings consists of chromium-nickel alloy when copper mesh is used and molybdenum when nickel mesh is used. The mesh electrode is stretched tautly between the support rings and welded thereto.

According to the present novel structure, the G4 electrode assembly 40 is modified to provide a structure having reduced microphonics without additional and costly processing or complex damped spring structures known in the prior art. It has been found that the resonant frequency of the nickel mesh electrode 42, shown in exaggerated thickness in FIGS. 2 and 3, may be increased and the microphonics decreased by uniformly retaining and resiliently supporting the nickel mesh electrode 42 between a rigid frustro-conically shaped support ring 44 and a spring-like frustro-conically shaped damping ring 46 that are secured together, for example, by welding around the periphery of the rings.

The nickel mesh electrode 42 is electroformed by a method well known in the art to have the desired mesh size which may range from 1000 wires per inch to 2000 wires per inch. The mesh electrode 42 includes a substantially circular mesh portion 48 circumscribed by a solid, non-apertured annular portion 50 which provides increased weldability and vibration damping properties as will be described hereinafter. Subsequent to electroforming, the mesh electrode 42 is fired in dry hydrogen at 720° C. for 20 minutes to remove surface contamination from the mesh.

The rigid mesh support ring 44 preferably comprises molybdenum although tantalum may be used. The mesh support ring 44 has a thickness of about 0.020 inch and is slightly "dished" by placing the support ring between a punch and die having an angle of about 6° to the horizontal to form a frustro-conically shaped ring. The reason for the frustro-conical shape will be made clear when the assembly of the mesh electrode 40 is described. The mesh damping ring 46 preferably comprises molybdenum although tantalum may also be used. The mesh damping ring 46 has a thickness of about 0.002 to 0.005 inch and is also slightly "dished" to an angle of about 11° to the horizontal to form a frustro-conically shaped ring. The punch and die method described above for forming the support ring 44 is also used to form the damping ring 46.

When the support ring 44 and the damping ring 46 comprise molybdenum, the surfaces of the rings may be roughened, for example by bead-blasting or other methods well known in the art, and plated with about 0.0002 inch of nickel to improve weldability. The nickel plating is not required if tantalum is used for the ring material since tantalum has satisfactory weldability.

Figure 2:
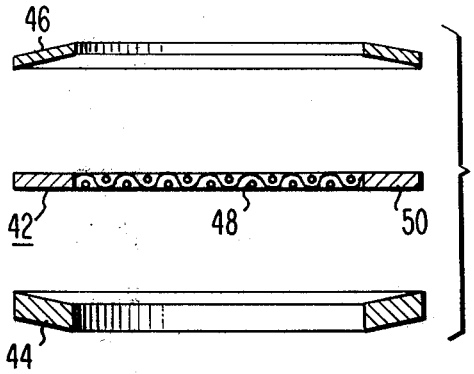
FIG. 2 is a partial exploded view of the mesh assembly of FIG. 1.
Figure 3:
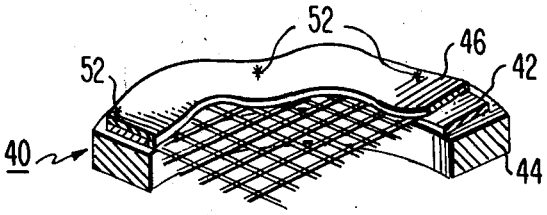
FIG. 3 is an enlarged fragmentary view of the mesh assembly showing the present novel structure in exaggerated detail.

As shown in FIGS. 2 and 3, the G4 electrode assembly 40 is formed by stretching the nickel mesh electrode 42 taut and disposing it between the support ring 44 and the damping ring 46. The apex of the frustro-conically support ring 44 is directed away from the mesh electrode 42 and toward the cathode 18 (see FIG. 1). The apex of the frustro-conically shaped damping ring 46 is initially directed away from the mesh electrode 42, however, the force exerted during welding of the non-apertured portion 50 of the mesh electrode 42 between the support ring 44 and the damping ring 46 is sufficient to compress the frustro-conically shaped damping ring 46 into a reversal of its dished shape and into a stressed condition thereby uniformly retaining the mesh electrode 42 between the support ring 44 and the compressively inverted damping ring 46. Since the damping ring 46 has an 11° upturn it cannot be fully inverted against the 6° upturned support ring 44 and mesh electrode 42. Consequently, a restoring force acts within the damping ring 46 to lift portions of the damping ring which are spaced from the welds away from the mesh electrode. As shown in FIG. 3, the welded points 52 which are equally spaced around the periphery of the damping ring 46 hold the damping ring in contact with the mesh electrode 42 in the areas of the welds. Cross-sectional photographs of electrode assembly 40 incorporating the present novel structure show that the damping ring 46 also contacts the mesh electrode 42 periodically around the inner periphery of the damping ring. The inner contact areas are radially aligned with the weld points 52 at the periphery of the damping ring 46.

Between adjacent weld points 52 the restoring force lifts the damping ring 46 to form an undulatory or wave-like configuration that extends around the damping ring. The above-described undulatory configuration permits any vibrations in the mesh electrode 42 to continue in the space between the support ring 44 and the damping ring 46. Since the damping ring 46 is spring-like but denser than the mesh electrode 42, the damping ring 46 absorbs energy from the mesh electrode thus suppressing mesh electrode vibrations and reducing microphonics.

Since the non-apertured portion 50 of the mesh electrode 42 is welded between the support ring 44 and the damping ring 46 there is a higher degree of weld integrity than could be obtained by welding to an apertured portion of the mesh electrode 42. The increase in density of the non-apertured portion 50 of the electrode 42 is also believed to contribute to the damping of mesh electrode vibrations.

While the mesh assembly 40 has been described as having an electroformed nickel mesh electrode 42, mesh electrodes made from materials having a Young's modulus greater than that for copper and nickel would also be suitable for mesh electrodes. Examples of such alternative materials include, but are not limited to, stainless steel and nickel-chromium alloys commercially available under the trademark, Nichrome.

General Considerations

The novel mesh assembly 40 including the nickel mesh electrode 42 provides improvements over prior art mesh assembly structures having copper mesh electrodes. In such tubes as the RCA 30 mm lead-monoxide vidicon, trade named the Vistacon, prior art copper mesh electrodes exhibited natural resonant frequencies in the range of 900 to 1800 Hz. with a damping time of about 2 to 7 seconds. In 30 mm Vistacons using the above described nickel mesh electrode secured between the novel frustro-conically shaped support ring 44 and undulatory damping ring 46, the average resonant frequency has been increased to about 2500 to 3200 Hz. and the damping time has been decreased to about 1 second or less.

The above described novel structure may utilize a molybdenum support ring 44 and a molybdenum damping ring 46, each plated with nickel. While molybdenum is preferred for the rings 44 and 46, tantalum may also be used. Both molybdenum and tantalum have annealing temperatures in excess of the highest tube processing temperature which is 750° C. (this temperature is applied to outgas the G3 electrode), thus assuring that the rings 44 and 46, respectively, will not soften and permit the mesh 42 to sag during tube processing. Since the annealing temperature of the mesh assembly 40 is never exceeded during tube processing or tube operation, the mesh assembly 40 remains stable through the tube life thus assuring that the resonant frequency of the nickel mesh electrode is substantially insensitive to thermal changes. The unannealed damping ring 46 is also resistent to fatigue and thus continues to operate effectively and reliably to damp vibrations over the life of the tube.

What is claimed is:

1. In a pick-up tube having a generally cylindrical envelope, a faceplate at one end of said envelope, a photoconductive target electrode adjacent to said faceplate, a cathode in the other end of said envelope and a mesh assembly disposed in spaced relation adjacent to said target electrode, between said target electrode and said cathode, the improvement wherein said mesh assembly comprises:

a mesh electrode disposed between a frustro-conically shaped mesh support ring and a dished, spring-like mesh damping ring, said mesh damping ring being fixedly attached at a plurality of spaced points around its outer periphery to said mesh electrode and said support ring, whereby said mesh damping ring is compressed into a reversal of its dished shape and assumes an undulatory configuration contacting said mesh electrode periodically around the inner periphery of said damping ring, thereby retaining said mesh electrode with reduced microphonics.

2. The pick-up tube as in claim 1, wherein said frustro-conically shaped mesh support ring has an apex directed toward said cathode.

3. The pick-up tube as in claim 1, wherein a restorative force acting on said fixedly attached mesh damping ring produces said undulatory configuration.

4. The pick-tube as in claim 1 wherein the mesh electrode includes a non-apertured annular portion secured between said damping ring and said support ring.

5. The pick-up tube as in claim 1 wherein the mesh damping ring and the mesh support ring are formed from a material selected from the group consisting of molybdenum and tantalum.

6. The pick-up tube as in claim 1 wherein the mesh electrode is formed from a material selected from the group consisting of nickel, nichrome and stainless steel.

7. The pick-up tube as in claim 5 wherein the mesh support ring and the mesh damping ring consist of molybdenum plated with nickel.

* * * * *